United States Patent [19]

Coors

[11] 4,309,582

[45] Jan. 5, 1982

[54] PUSH BUTTON SWITCH FOR A CONTROLLER

[75] Inventor: George T. Coors, Tipp City, Ohio

[73] Assignee: Ledex, Inc., Vandalia, Ohio

[21] Appl. No.: 159,022

[22] Filed: Jun. 13, 1980

[51] Int. Cl.[3] ..... H01H 25/04

[52] U.S. Cl. ..... 200/153 T; 200/6 A; 200/335; 200/339; 200/340

[58] Field of Search ..... 200/340, 6 A, 157, 159 R, 200/153 T, 153 H, 329, 335, 339

[56] References Cited

U.S. PATENT DOCUMENTS

| | | | |
|---|---|---|---|
| 2,841,659 | 7/1958 | Eitel | 200/6 A |
| 3,056,867 | 10/1962 | Eitel | 200/6 A |
| 3,818,154 | 6/1974 | Presentey | 200/6 A |
| 3,827,313 | 8/1974 | Kiessling | 200/6 A |
| 4,206,602 | 6/1980 | Watson et al. | 60/433 |

*Primary Examiner*—Willis Little

*Attorney, Agent, or Firm*—Biebel, French & Nauman

[57] ABSTRACT

In a controller of the type having a body, a pivot member within the body and an actuator shaft on the pivot member, a push button switch for the controller includes a handle fitted over an external end of the shaft and having a longitudinal opening therethrough, a push rod slidably positioned within the opening, a collar connected to the push rod, a switch operator which slidably engages the collar, and a switch positioned between the switch operator and the body such that, as the push rod is displaced toward the body, the push rod urges the collar to displace the switch operator toward the body thereby operating the switch. The switch operator preferably has an outer convex or arcuate bearing surface and an opening through which passes the actuator shaft. The sliding collar preferably has a lower concave portion which slidably engages the bearing surface of the switch operator, so that the push rod can actuate the switch at any given position of the controller.

18 Claims, 2 Drawing Figures

PUSH BUTTON SWITCH FOR A CONTROLLER

BACKGROUND OF THE INVENTION

1. Field of the Invention

The present invention relates to push button switches, and more particularly to push button switches which are used in combination with so-called "joy-stick" controllers.

2. Prior Art

Mechanical actuating lever controllers, commonly referred to as joy-stick actuators, are widely used in industry as a part of automatic control systems. In the copending application Ser. No. 110,969 filed Jan. 10, 1980 there are disclosed joy-stick actuators which have a shaft fitted to a pivot member, a socket holding the pivot member, a follower member having a central opening to receive a lobe protruding from the lower portion of the pivot member, and an electrical output device. Movement of the actuator shaft results in a movement of the lobe and subsequent movement of the follower member which positions a moving element of the output device.

Controllers of this type can be used, for example, to position a work piece below a cutting machine: movement of the actuator shaft in a given direction activating the output transducer to operate a work piece moving device to move a work piece in a similar direction. When more than one transducer is mounted within the controller adjacent the follower member, it is possible to generate signals from the transducers which can activate machinery to move work piece to any position on a plane.

It is desirable to incorporate a push button operated switch in the actuator shaft of this type of controller so that an additional function may be activated. For example, once a work piece is in the desired position, a push button located in the handle may be depressed to close a switch thereby activating a cutting torch to begin a cutting operation. In addition, it is also desirable to place a push button in the actuator shaft of a controller such that no lead wires travel from a movable member thus preventing fraying or shorting of the wires. Such a switch must be easily operable regardless of the degree of tilt of the actuator shaft relative to the body of the controller.

SUMMARY OF THE INVENTION

This inventon provides a push button switch for a joy-stick type controller in which no electrical wires pass from the handle portion of the lever to the body thus eliminating break downs due to fraying or shorting. In addition, the invention provides a push button switch which does not require sliding or wiping electrical contacts and which eliminates break downs resulting from corrosion and wear of moving switch contacts. An important aspect of the present invention is that the push button switch may be operated with equal facility regardless of the position of the actuator shaft relative to the body of the controller.

The push button switch is embodied in a controller having a body and a tubular, pivotally mounted actuator shaft. The push button switch comprises a handle mounted on an external end of the actuator shaft and having a longitudinal opening therethrough. A push rod is slidably positioned within the opening in the handle. A collar is positioned below the handle having a neck portion which slidably engages the shaft and having a concave portion. A switch operator is positioned below the collar having a curved or convex bearing surface which slidably engages the concave portion of the collar and a central opening through which passes the actuator shaft. The hemispherical bearing surface and the concave portion of the collar have coincidental centers of curvature located at the center of the pivotal mount of the actuator shaft. Thus, the bearing surface and the concave portion can slide smoothly against each other.

A miniature switch is located between the switch operator and the body of the controller. In a preferred embodiment of the invention, the body of the controller has an internal wall and floor which form a recess and the switch operator is shaped to fit within the recess and slidably engage the recess side wall for limited movement so that the operator is capable of movement only in a direction parallel to the side wall of the body.

To activate the miniature switch, the push rod is displaced toward the body and engages the collar which depresses the switch operator toward the body, thereby engaging and operating the switch. The switch is mounted to the body within the recess and the lead wires from the switch do not move as the lever arm is moved.

In a preferred embodiment, the opening in the switch operator is smaller than the largest dimension of the concave portion of the collar. Therefore, regardless of the position of the handle relative to the body, a displacement of the push rod will force the sliding collar to depress the switch operator toward the body and activate the switch.

The preferred embodiment of the invention is designed so that the miniature switch cannot be damaged inadvertently by depressing the push rod too far. The opening in the handle of the controller has a constricted portion at its top and the external end of the actuator shaft is threaded into the opening to form a chamber which extends between the constricted portion and the external end of the shaft. The push rod has a thickened portion in the shape of a cylinder which is located within the chamber but is shorter in length than the chamber so that it may travel within the chamber between the constricted portion of the opening and the external end of the shaft. Thus, the push rod is permitted to travel only the predetermined distance between an end of the cylinder and the external end of the actuator shaft.

Also in the preferred embodiment, the actuator shaft has a pair of opposing longitudinal slots and the neck portion of the collar includes a pin which passes through its center and through the longitudinal slots. The push rod which extends through the opening in the handle abuts this pin at its end. Thus, as the push rod is displaced toward the body, the push rod presses against the pin and moves the entire collar to depress the switch operator thereby actuating the switch.

In the preferred embodiment, the miniature switch includes a bracket which is mounted on the floor of the recess in the body, so that the switch can be adjusted to vary the distance between the switch and the switch operator. The switch is maintained in an unactuated position by a biasing means, which can be a spring, located on an opposite side of the floor from the switch and between the switch operator and the floor of the recess so that the switch operator is urged away from the floor of the recess.

In the two-axis embodiment disclosed, the controller has two electrical output devices, such as LVDT's, oriented normal to one another so that movement of the lever arm activates both output devices. It is particularly adapted by use with the controllers disclosed in my copending application Ser. No. 110,969 filed Jan. 10, 1980. For example, the controller of the present invention could be modified by adding a cup-shaped gate-plate having a cruiciform slot therethrough to the controller body. The lever arm would extend through the slot and be restricted to movement along the perpendicular axes of the slot.

In another embodiment of the aforementioned copending application, the lever arm is mounted in a pivot disc instead of a pivot ball so that the lever arm is restricted to uniaxial movement. An arcuate, rectangular gate-plate with a single slot is mounted on the body of the controller so that the lever arm would extend through the slot and thus be restricted to movement within the slot. This embodiment can easily be adapted to receive the lever arm, collar, switch operator, and switch of the present invention.

Accordingly, it is an object of the invention to provide a push button switch for a controller which eliminates the need for wires to travel from the handle or actuator shaft to a switching means; to provide a push button switch in the handle of an actuator shaft which can open or close a switch easily regardless of the orientation of the actuator shaft with respect to the body of the controller; and to provide a push button switch which does not require sliding or wiping electrical contacts which may easily foul.

Other objects and advantages of the invention will be apparent from the following description, the accompanying drawings and the appended claims.

DETAILED DESCRIPTION OF THE PREFERRED EMBODIMENT

Figure 1:
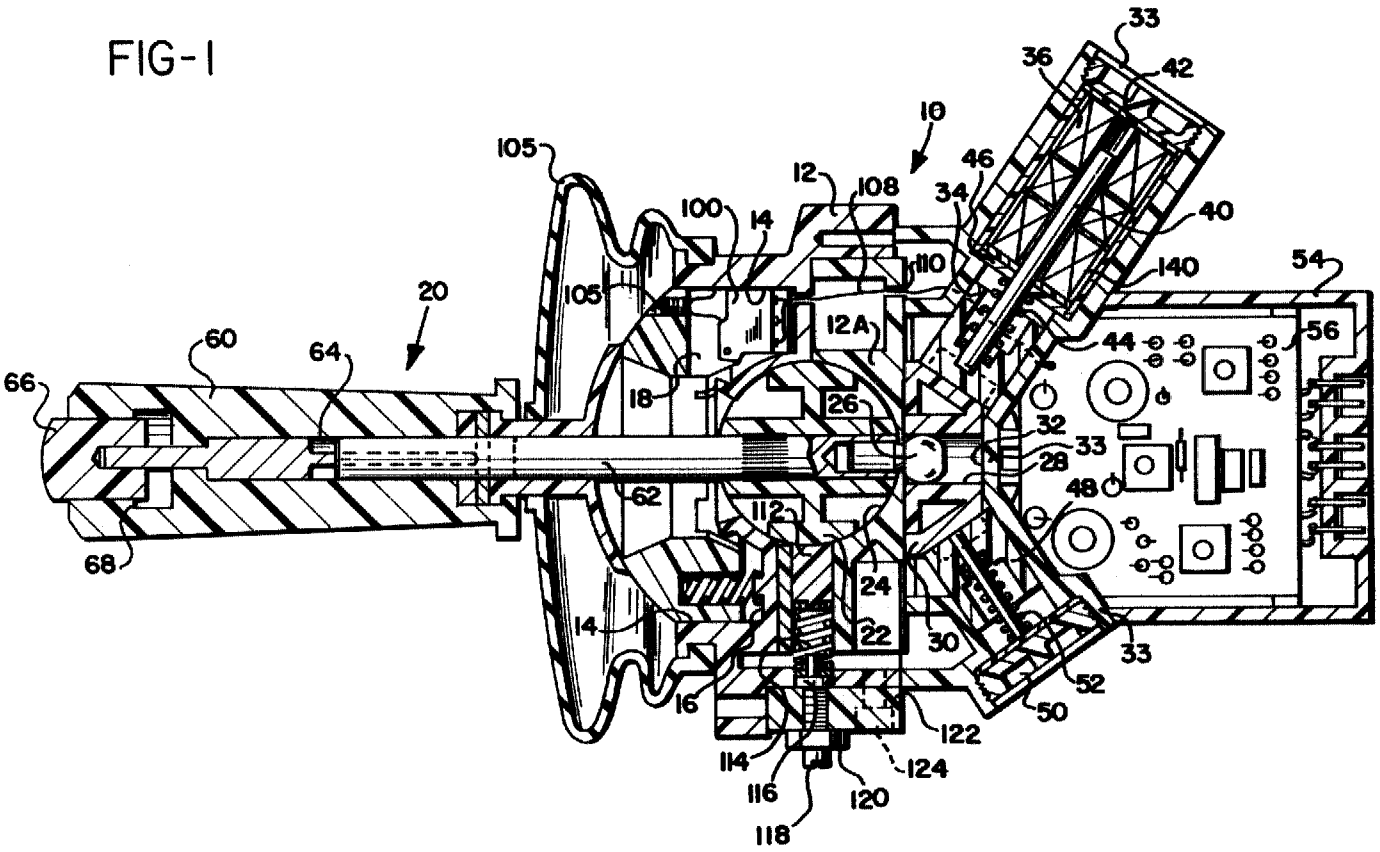
FIG. 1 is a side view, in section, of a controller of the present invention.

As shown in FIG. 1, the present invention is incorporated as part of a joy-stick controller 10 made essentially according to the teachings of my copending application Ser. No. 110,969, as mentioned above. The controller 10 consists of a body 12 having an interior wall 14 and a floor 16 which forms a recess 18. A lever arm, generally designated 20, is press fitted into a pivot ball 22 which is captured for rotation within a socket 24 located in the body 12 and an attached inner body portion 12A.

A lobe 26 extends from the lower portion of the pivot disc or ball 22 and engages the walls of an opening located in the center of a conical follower member 30. The follower member 30 abuts a surface 32 of a transducer housing 33 and a plunger 34 of a transducer 36 mounted within the housing 33 which forms an integral part of the body 12.

The transducer housing 33 contains a variable voltage output device, preferably a differential transformer or LVDT type of transducer 36. However, linear resistors or other types of positive-responsive output devices may be used. The transducers 36 include an armature 40 movably positioned within a cavity 42 of the transducer. The plunger 34 is urged against the follower member 30 by a coil spring 44 which extends between the plunger 34 and a washer 46 located adjacent the transducer 36.

To balance the follower member 30, a second plunger 48, located directly opposite the plunger 34 of the transducer 36, abuts an opposite sloping side of the follower member 30. The second plunger 48 is fitted within a plunger housing 50 and is urged against the follower member 30 by a balance spring 52.

Figure 2:
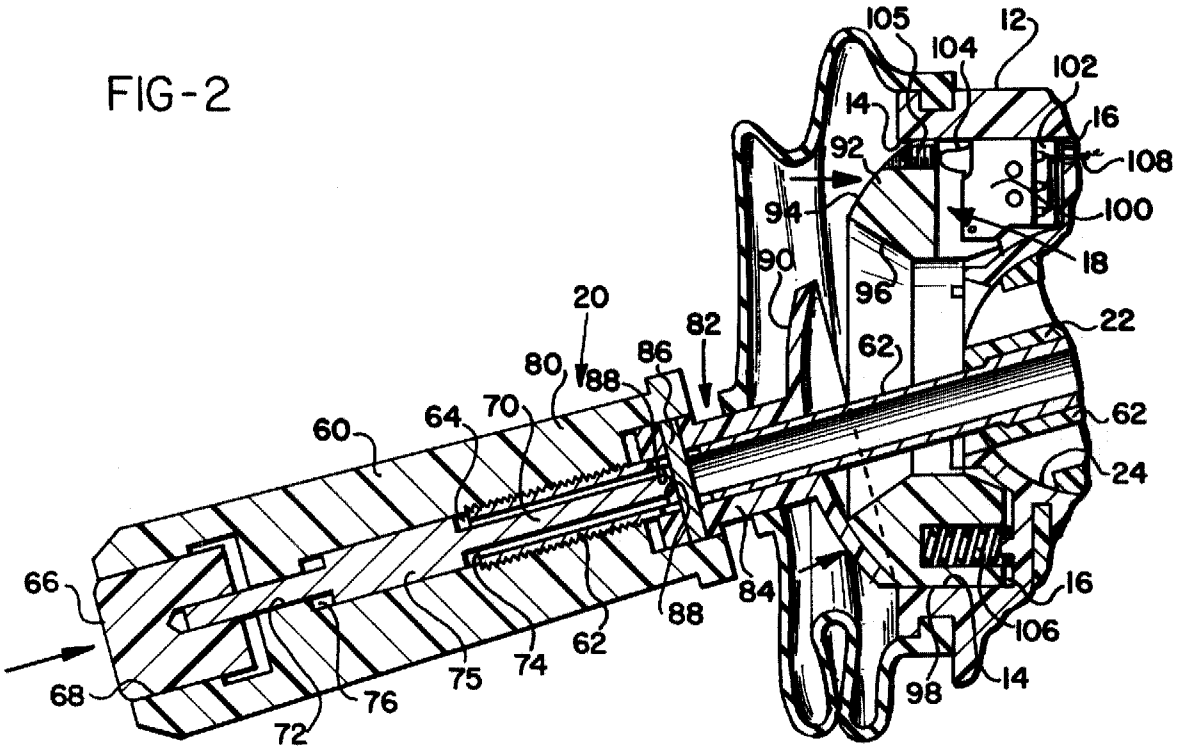
FIG. 2 is an enlarged partial side view, in section, of the controller incorporating the present invention in which the push button is depressed to activate the switch and the handle is tilted.

It should be noted that FIGS. 1 and 2 are half-section views of the controller of the present invention. The controller may have a second voltage output device (not shown) mounted on the transducer housing 33 and oriented normal to transducer 36. The second output device would be paired with an opposing plunger (not shown), mounted on the housing 33 normal to plunger 48, all as described in my copending application.

A cylindrical casing 54 which may house a printed circuit board 56 is located below the follower member 30 and forms an integral part of the body 12. In this fashion, the transducer 36 can be wired directly to the desired circuit board 56 and the entire controller 10 can be installed as a unit.

The push button switch of the present invention fits within the recess 18 and lever arm 20. The arm 20 includes a handle 60 threaded onto a tubular shaft 62. The shaft 62 is press fitted into the pivot ball 22 and receives the lobe 26 which engages the follower member 30. The handle 60 has a central opening 64 which is countersunk at its upper end to form a recess 68 to receive a push button 66. As best shown in FIG. 2, the push button 66 is press fitted to a push rod 70 which extends the length of the central opening 64. The opening 64 has a constricted portion 72 and forms a chamber 76 which extends from the constricted portion to the external end 74, of the shaft 62. The push rod 70 has a thickened cylindrical portion or piston 75 located within the chamber 76 and is of a length less than that of the chamber.

The handle 60 is countersunk at its lower end 80 to receive a collar 82 having a tubular neck portion 84 which slidably engages the shaft 62. The neck portion 84 of the collar 82 carries a transverse pin 86 which is press fitted through the center of the collar 82 and is received through a pair of opposing longitudinal slots 88 formed in the shaft 62.

A concave inner portion 90 of the collar 82 slidably engages an annular switch operator 92. The operator 92 has an outer convex bearing surface 94 and defines a central passage 96 for the shaft 62. The inner portion 90 and bearing surface 94 have coincidental centers of curvature located in the center of pivot ball 22. Thus, the inner portion 90 will move smoothly against bearing surface 94 at all times.

The switch operator 92 is shaped to fit within the recess 18 of the body 12 so that side walls 98 of the switch operator 92 slidably engage the interior annular wall 14 of the recess, thereby restricting the movement of the switch operator within the recess to a direction parallel to the interior wall 14 of the recess.

A miniature switch 100 is mounted on an L-shaped flange 102 which is cemented or fused to the floor 16 of the recess 18. A U-shaped actuator 104 extends upward from the switch 100 and abuts an adjusting screw 105 carried in the switch operator 92. The switch operator 92 is maintained in a raised position by a biasing means which preferably comprises coil springs 106 located beneath the switch operator 92. Although only one coil spring 106 is shown, it is preferable to include at least three spaced evenly beneath the switch operator 92. The wiring 108 from the switch 100 can be connected directly to the circuit board 56 by means of a pathway 110 (FIG. 1) which passes through the body 12 of the controller 10.

In order to maintain the lever arm 20 in a fixed position while the switch 100 is being activated, the pivot ball 22 can be held in place by a friction pad 112 (FIG. 1) which is urged against the pivot ball 22 by a spring 114 which extends between the friction pad 112 and a flat washer 116. The compression of the spring 114 and consequently the force exerted by the friction pad 112 against the pivot ball 22 can be varied by turning and adjusting screw 118, retained by a hex nut 120, which urges the flat washer 116 toward the pivot ball 22. The friction pad 112, spring 114, and flat washer 116 are retained by a block 122 which is held to the body 12 by screws 124.

The operation of the push button switch is best shown in FIG. 2. As the push button 66 is depressed, it urges the push rod 70 against the pin 86 fitted within the neck portion 84 of the collar 82. Consequently, the push rod 70 presses the sliding collar 82 downward, thereby urging the switch operator 92 toward the floor 16 of the recess 18. As the switch operator 92 travels toward the floor 16 the actuator 104 of the switch 100 is depressed, finally closing or operating the switch 100 and activating the desired circuit.

When the push rod 70 is urged toward the body 12, the piston 75 travels along the chamber 76 toward the external end 74 of the shaft 62. The external end 74 prevents further movement of the push rod 70 when the lower portion of the piston 75 abuts the external end 74. At the time the piston 75 abuts the external end 74, the switch operator 92 has been depressed sufficiently by the collar 82 to activate the switch 100. Thus, damage to the switch 100 or the actuator 104, which might be sustained if the switch operator 92 was pressed too close to the floor 16, is prevented.

As best shown in FIG. 2, the push button switch 66 is capable of operation when the lever arm 20 is displaced at an angle relative to the body 12 of the controller. In this situation, the concave portion 90 of collar 82 merely slides over the bearing surface 94 of the switch operator 92, maintaining at all times an area of contact with the switch operator. Since the switch operator 92 is constrained within the interior wall 14 of the recess 18, any force exerted against the convex bearing surface 94 by the collar 82 is translated into a unidirectional movement of the switch operator 92 along the interior wall 14 of the recess 18. Thus, the push button switch is capable of operation regardless of the position of the lever arm 20 relative to the body 12.

Most of the components of the push button switch of the present invention can be made of various plastics. For example, the collar 82 and the switch operator 92 can be fabricated from glass-filled nylon and the handle can be fabricated from a polycarbonate. The body and pivot ball can be fabricated from a glass-filled polyester. However, the shaft 62 may be fabricated from metal such as extruded aluminum tubing or solid tubing countersunk to receive the push rod and pin.

The invention can be modified so that the miniature switch may be in the form of a proximity sensor, Hall effect switch, or a fiber optic arrangement.

While the form of apparatus herein described constitutes a preferred embodiment of this invention, it is to be understood that the invention is not limited to this precise form of apparatus, and that changes may be made therein without departing from the scope of the invention.

What is claimed is:

1. An improved controller of the type having a body, a shaft, and means for pivotally mounting the shaft in the body, wherein the improvement comprises:

a handle on an end of the shaft, the shaft and handle having a longitudinal opening therein;

rod means slidably positioned within the opening;

a collar connected to the rod means;

switch operator means having an outer convex bearing surface slidably engaging the collar and defining a cental passage through which passes the shaft; and switching means positioned between the switch operator means and the body such that, as the rod means is displaced toward the body, the rod means urges the collar to displace the switch operator means toward the body thereby operating the switching means.

2. The controller of claim 1 wherein the body includes an interior wall and floor which form an upper recess and the switch operator means fits within the upper recess and slidably engages the interior wall such that its movement is restricted to a direction parallel to the wall.

3. The controller of claim 2 wherein the switch operator means includes a biasing means which abuts the floor of the recess and the switching means includes a bracket mounted on the floor.

4. The controller of claim 1 wherein the collar includes a neck portion which slidably engages the shaft and a concave end which slidably engages the outer convex bearing surface of the switch operator means.

5. The controller of claim 4 wherein the neck portion has a tubular shape which encloses and is coaxial with the shaft.

6. The controller of claim 4 wherein the shaft has a pair of opposing longitudinal slots proximate the external end and the neck portion of the collar includes a pin which passes through the longitudinal slots such that the rod means abuts the pin.

7. The controller of claim 1 wherein the longitudinal opening in the handle includes a constricted portion and the external end of the shaft is fixedly journaled within the opening such that a chamber is formed between the constricted portion and the external end of the shaft.

8. The controller of claim 6 wherein the rod means includes a piston portion within the chamber of a length less than that of the chamber such that the movement of the rod means is limited by the travel of the piston portion within the chamber.

9. An improved controller of the type having a body which includes an interior wall and a floor forming an upper recess, a shaft having an external end and a pair of opposing longitudinal slots proximate the external end, and a means for pivotally mounting the shaft in the body, wherein the improvement comprises:

a handle fitted over the external end of the shaft, the handle and shaft having a longitudinal opening therethrough which includes a constricted portion within the handle and the external end of the shaft is fixedly journaled within the opening such that a chamber is formed between the constricted portion and the external end;

a rod means slidably positioned within the opening and having a piston portion located within the chamber of a length less than that of the chamber such that a movement of the rod means is limited by the travel of the piston portion within the chamber;

a collar having a tubular neck portion which encloses and slidably engages the shaft and a concave end;

a switch operator means having an outer convex bearing surface which slidably engages the concave end of the collar and a central passage through which passes the actuator shaft, the switch operator means fitting within the upper recess and slidably engaging the interior wall such that its movement is restricted to a direction parallel to the wall; and a switching means positioned between the switch operator means and the floor and having an actuator extending between the switching means and the switch operator means, and having a bracket mounted on the floor of the recess such that, as the rod means is displaced toward the body, the rod means urges the collar to displace the switch operator means toward the body thereby closing the actuator of the switching means.

10. The controller of claim 9 wherein the switching means comprises a miniature switch.

11. In a controller of the type having a body, a shaft, and means for pivotally mounting the actuator shaft in the body, a push button switch comprising:

a handle fitted over an external end of the shaft, the handle and shaft having a longitudinal opening therethrough;

rod means slidably positioned within the opening;

push button means slidably mounted within the handle and abutting the rod means;

a collar connected to the rod means;

switch operator means having an outer convex bearing surface slidably engaging the collar and defining a central passage through which passes the shaft; and switching means positioned between the switch operator means and the body such that, as the push button means is displaced toward the body, the rod means urges the collar to displace the switch operator means toward the body thereby closing the switching means.

12. The push button switch of claim 11 wherein the body includes an interior wall and floor which form an upper recess and the switch operator means fits within the upper recess and slidably engages the interior wall such that its movement is restricted to a direction parallel to the wall.

13. The push button switch of claim 12 wherein the switch operator means includes a biasing means which abuts the floor of the recess and the switching means includes a bracket mounted on the floor.

14. The push button switch of claim 11 wherein the collar includes a neck portion which slidably engages the shaft and a concave end which slidably engages the outer convex bearing surface of the switch operator means.

15. The push button switch of claim 14 wherein the neck portion has a tubular shape which encloses and is coaxial with the shaft.

16. The push button switch of claim 11 wherein the shaft has a pair of opposing longitudinal slots proximate the external end and the neck portion of the collar includes a pin which passes through the longitudinal slots such that the rod means abuts the pin.

17. The push button switch of claim 16 wherein the rod means includes a piston portion within the chamber of a length less than that of the chamber such that the movement of the rod means is limited by the travel of the piston portion within the chamber.

18. The push button switch of claim 11 wherein the longitudinal opening in the handle includes a constricted portion and the external end of the shaft is fixedly journaled within the opening such that a chamber is formed between the constricted portion and the external end of the shaft.

* * * * *